US005637013A

United States Patent [19]

Weber

[11] Patent Number: 5,637,013

[45] Date of Patent: Jun. 10, 1997

[54] POWER SUPPLY CORD WITH A MOLDED PRE-ASSEMBLED ELECTRICAL CONTACT CARRIER AND THE CARRIER

[75] Inventor: William J. Weber, Eaton, Ohio

[73] Assignee: Belden Wire & Cable Company, Richmond, Ind.

[21] Appl. No.: 356,977

[22] Filed: Dec. 16, 1994

[51] Int. Cl.[6] ..... H01R 11/00

[52] U.S. Cl. ..... 439/502; 439/568

[58] Field of Search ..... 439/171, 172, 439/176, 502, 445, 447

[56] References Cited

U.S. PATENT DOCUMENTS

| | | | |
|---|---|---|---|
| 3,083,344 | 3/1963 | Long | 439/172 |
| 4,632,121 | 12/1986 | Johnson et al. | 439/502 |
| 4,723,822 | 2/1988 | Merdic | 439/502 |
| 4,728,163 | 3/1988 | Kittinger et al. | 439/172 |
| 5,192,226 | 3/1993 | Wang | 439/502 |
| 5,320,560 | 6/1994 | Fladung | 439/502 |
| 5,466,172 | 11/1995 | Carstens et al. | 439/502 |

*Primary Examiner*—Neil Abrams
*Assistant Examiner*—Brian J. Biggi
*Attorney, Agent, or Firm*—Laff, Whitesel, Conte & Saret, Ltd.

[57] ABSTRACT

An electrical appliance or tool having a pre-assembled electrical contact carrier on one end thereof. The carrier has a flex strain relief surrounding one end of the power cord. A flange is connected to the strain relief and is sized to contact the exterior of the appliance or tool to hold the power cord on to the appliance or tool. A retaining head is attached to and spaced from the flange to be located in the interior of the appliance or tool. The retaining head has at least a pair of electrical contacts which can be mechanically and electrically connected to corresponding lead wire contacts. The invention also concerns the pre-assembled power cord electrical contact carrier.

13 Claims, 7 Drawing Sheets

POWER SUPPLY CORD WITH A MOLDED PRE-ASSEMBLED ELECTRICAL CONTACT CARRIER AND THE CARRIER

FIELD OF THE INVENTION

This invention relates to power supply cords. More particularly, this invention relates to power supply cords having a molded pre-assembled electrical contact carrier and a flex strain relief tail at one end and a two or three blade plug at the other end thereof. This invention also relates to the carrier.

BACKGROUND OF THE INVENTION

Power supply cords are generally small, flexible electrical cables having a plug on at least one end which is used to connect an appliance or electrical tool with a wall outlet or receptacle. These cords include one or more insulated leads which typically project from the end of the cord and extend to various points within the appliance. The cord generally also has on the end, a flex/strain relief which attaches the cord to the appliance. The cord and/or insulated leads project through the strain relief and the insulated leads are mechanically attached or soldered to electrical contacts within the applicance.

The effective length of a power supply cord required for a particular appliance is usually measured from the receptacle plug to the point at which it is mounted to the appliance. Since the insulated leads typically extend to various points within the appliance, the actual overall length of the cord and the lead termination vary widely depending upon the application. Presently, the wide variation in the lengths of the power supply cords is addressed by customizing the cords for each particular application. Thus, conventional methodology has resulted in an infinite number of customized power supply cords.

While customized power supply cords provide a generally adequate means to connect an appliance with a receptacle, there are problems associated with their use. First, customizing power supply cords for each individual application requires costly jacket removal, filler cutting, and excessive amounts of cordage. Furthermore, customizing power supply cords requires manual lead cutting and termination, and further requires attaching or soldering the insulated leads to the conductors or contacts within the applicance. Such requirements are both time-consuming and costly. In addition, the customization of power supply cords requires storage of the different cord types which has increased inventories.

Accordingly, an object of the present invention is to provide a power supply cord assembly that has a molded preassembled electrical contact carrier on one end and minimizes jacket removal, filler cutting operations, and the amount of cordage required.

Another object of the present invention is to provide a power supply cord assembly that provides for automated lead cutting and termination.

Another object of the present invention is to provide a power supply cord assembly which reduces inventories because only a few basic cords must be stocked.

A further object of the present invention is to provide an electrical appliance power supply cord assembly that has a substantially cylindrical power cord having a first and second end, a two or three prong plug attached to the first end of the power cord, an electrical contact carrier attached to the second end of the power cord; the carrier having external means and internal means to attach the carrier to an electrical appliance or tool, the internal means having at least two female or male electrical contacts which are electrically attached to the power cord, the female or male electrical contacts being sized to mechanically receive and electrically connect appliance to lead wires having corresponding male or female electrical contacts.

SUMMARY OF THE INVENTION

The present invention accomplishes the foregoing objects by providing a molded pre-assembled flex/strain relief electrical contact carrier for connecting a conventional power supply cord to an appliance. The molded carrier enables a finite number of conventional power supply cords with the most common lengths, gauge sizes, and cordage types to be manufactured.

The molded carrier is used in conjunction with a conventional power supply cord which comprises a cable having an outer jacket which defines a core. At least one insulated conductor is located within the core. The cable includes a first end and a second end. The first end of the cable is integrally formed with an electrical two or three prong plug for insertion into an outlet. The second end of the cable forms an interface with the molded electrical contact carrier.

A tapered flexible strain relief is usually attached to or molded with the electrical contact carrier. The strain relief and electrical contact carrier circumferentially surrounds the second end of the cable. The flexible strain relief includes strain relief first and second ends. The strain relief first end is spaced from the second end of the cable and includes a first smaller outer diameter. The strain relief second end has a second larger outer diameter. The strain relief second end has a shoulder or flange which is integral with or attached to the strain relief. The electrical contact carrier is attached to or integral with the flange and forms an appliance receiving groove with the flange. The flexible strain relief preferably includes a plurality of bores disposed over its surface, with the bores preferably being perpendicular to the longitudinal axis of the flexible member.

The electrical contact carrier has a retaining head for housing the electrical contacts. The retaining head has extending from one end a spacer. The spacer has a circumference which is smaller than the circumference of the flange and the one end of the retaining head and forms an appliance or tool retaining groove between the retaining head and the flange. The groove is sized to receive a portion of the appliance and affix the power cord to the appliance. The retaining head generally includes two or three electrical contacts which would be located in the appliance. In the preferred embodiment, the retaining head securely abuts against an inner surface of the appliance or tool with the electrical contacts being in the appliance or tool and the flange abuts against an outer surface of the appliance or tool with the strain relief outside the appliance or tool.

In one embodiment, the electrical contact carrier has a longitudinal axis that is parallel to the longitudinal axis of the flexible member and the cable. The electrical contacts are at least one female contact that will be in the appliance or tool and the female contact is located on the end face of the carrier. In an alternate embodiment, there is at least one female contact on a side face of the carrier. The preferred structure has at least two female contacts which can be mechanically and electrically connected to male contacts on the appliance or tool inner lead wires or male contacts on an appliance or tool contact plate.

In a variation of the above the retaining head is generally L-shaped and off-center from the flange.

DETAILED DESCRIPTION OF THE INVENTION

Figure 1:
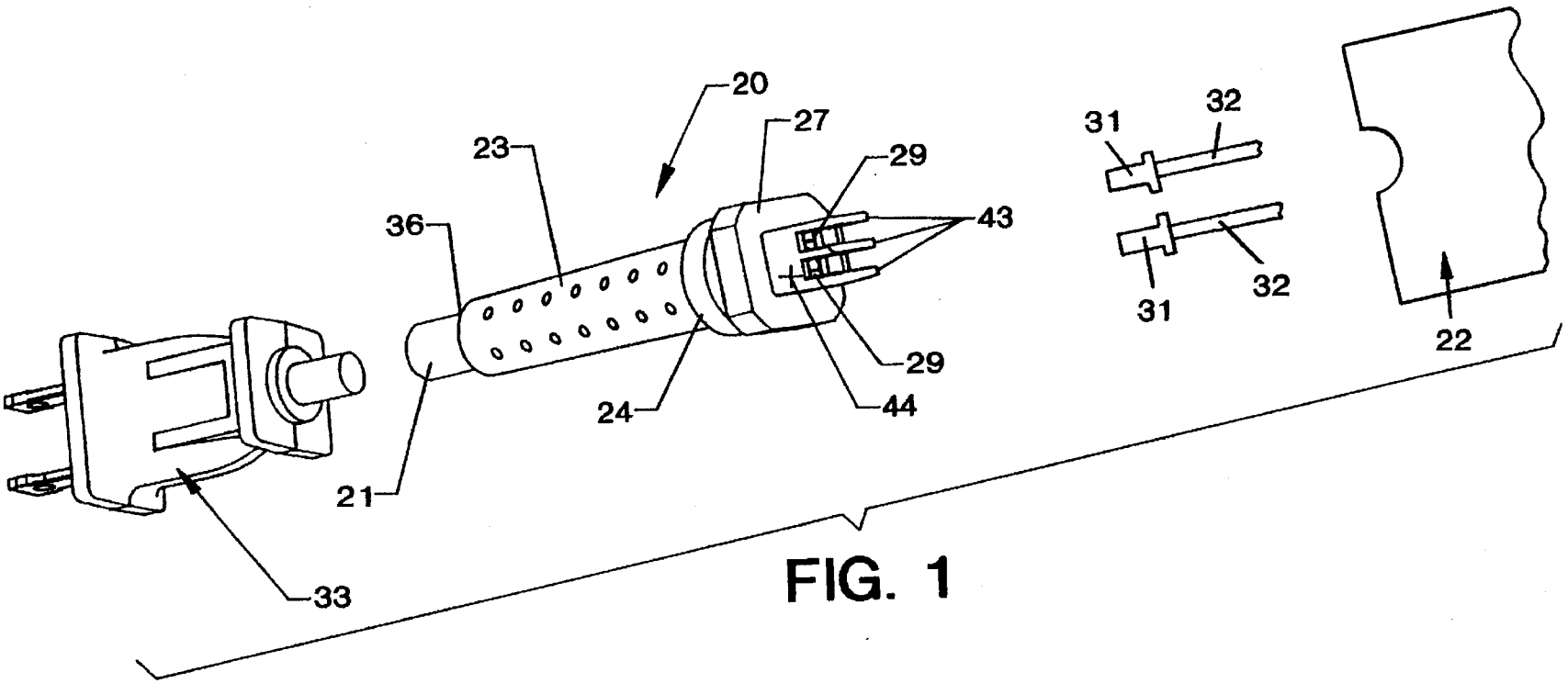
FIG. 1 is an enlarged perspective view of the of the inventive electrical appliance or tool power supply cord assembly of the present invention.
Figure 2:
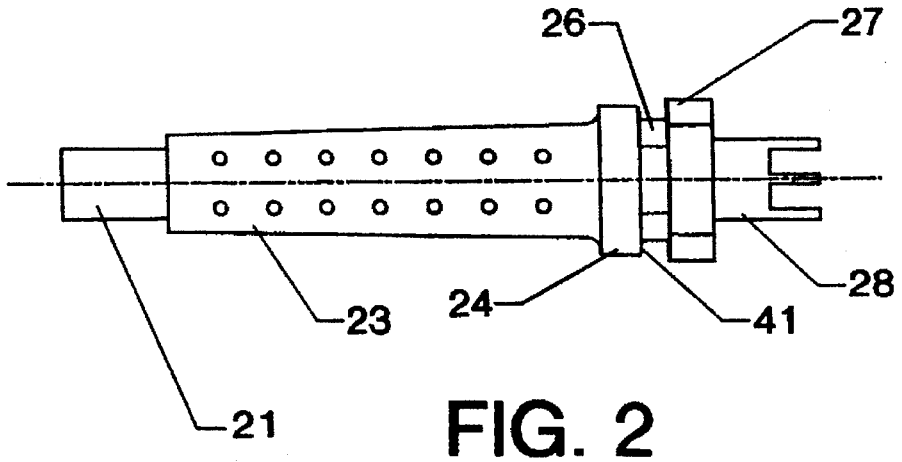
FIG. 2 is a front view of the electrical contact carrier and strain relief tail of the present invention.

Generally referring to FIGS. 1–6, the invention provides, in a preferred embodiment, a molded pre-assembled electrical contact carrier and strain relief denoted by the numeral 20, for connecting a power supply cord 21 to an electrical appliance 22. The carrier 20 is shown as having a flexible strain relief tail 23, an outside appliance flange 24, a spacer 26, a retaining head 27 that includes a contact housing 28. The contact housing contains two female electrical contacts 29. The female contacts are sized to receive the male contacts 31 attached to appliance lead wires 32 for routing to different connections within the appliance.

Figure 10:
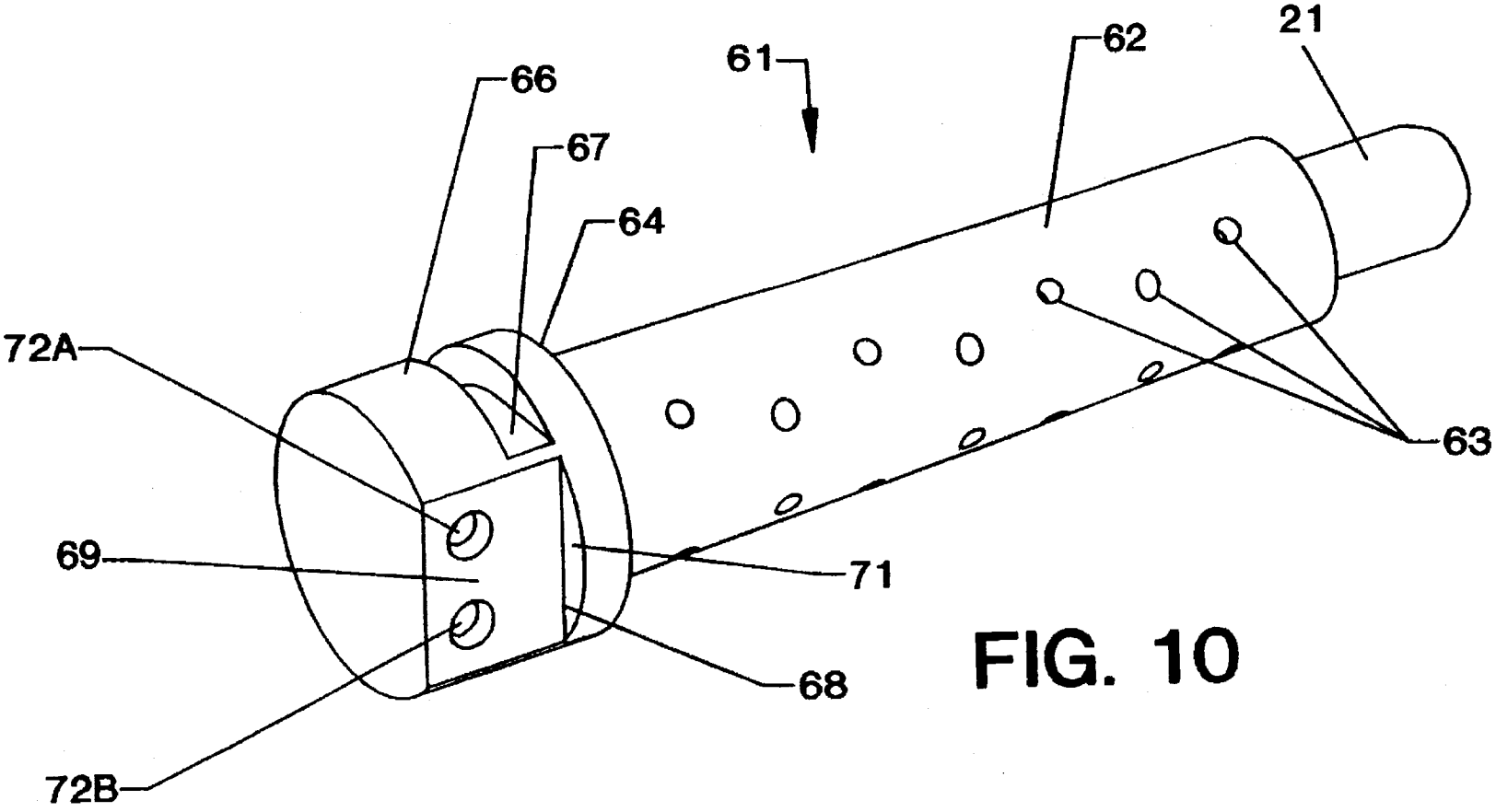
FIG. 10 is a perspective view of another embodiment of the present invention.
Figure 11:
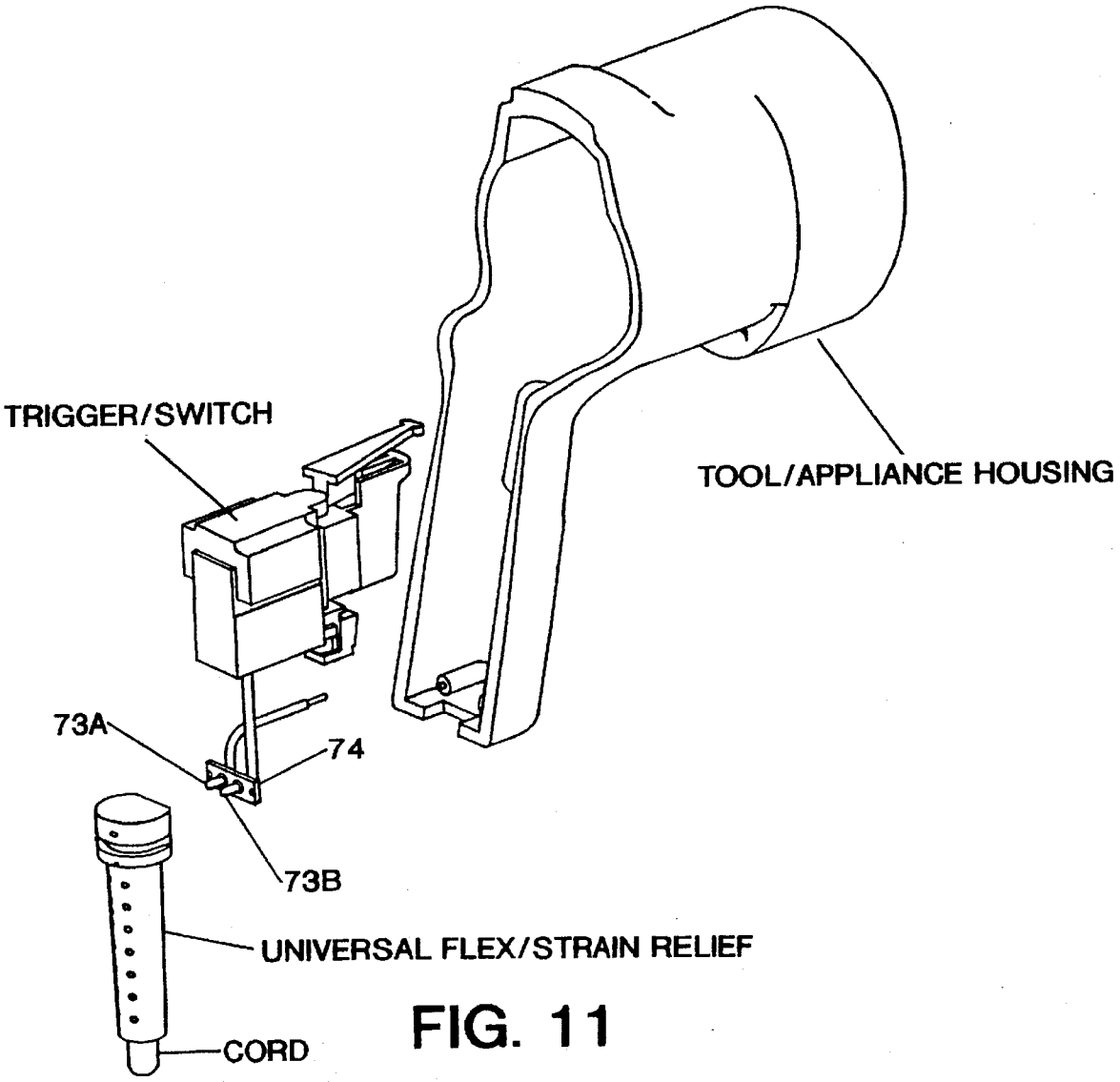
FIG. 11 is a perspective view illustrating the embodiment of FIG. 10 being attached to a housing.

In an alternate embodiment, the female electrical contacts on the flexible member is adapted to receive contacts from a contact plate for routing to the various connections within an appliance (FIGS. 10, 11).

The carrier 20 is used in conjunction with a conventional power supply cord 21 which has on its first end a molded preassembled two or three pronged plug 33 for insertion into an electrical outlet.

The second end of cable 21 has the electrical carrier and strain relief 20 connected thereto. The length 34 is about 2.0 to 4.0 inches for power tools and household appliances.

The strain relief tail 23 has a generally tapered outside profile with the interior being cylindrical to circumferentially surround the cord or cable 21. A first end 36 is spaced outside from the second end of the cable 21 and a strain relief tail second end 37. The outside diameter of the first end 36 is smaller than the outside diameter of the second end 37. The flange 24 may be integral with the strain relief tail second end 37. If it is not integral with the strain relief tail 23, it is bonded to the strain relief tail when the tail and retaining head are attached to the cord 21. The attachment is carried out in the same manner as when a pre-assembled plug is attached to a cord, i.e., by heat and pressure.

Figure 6:
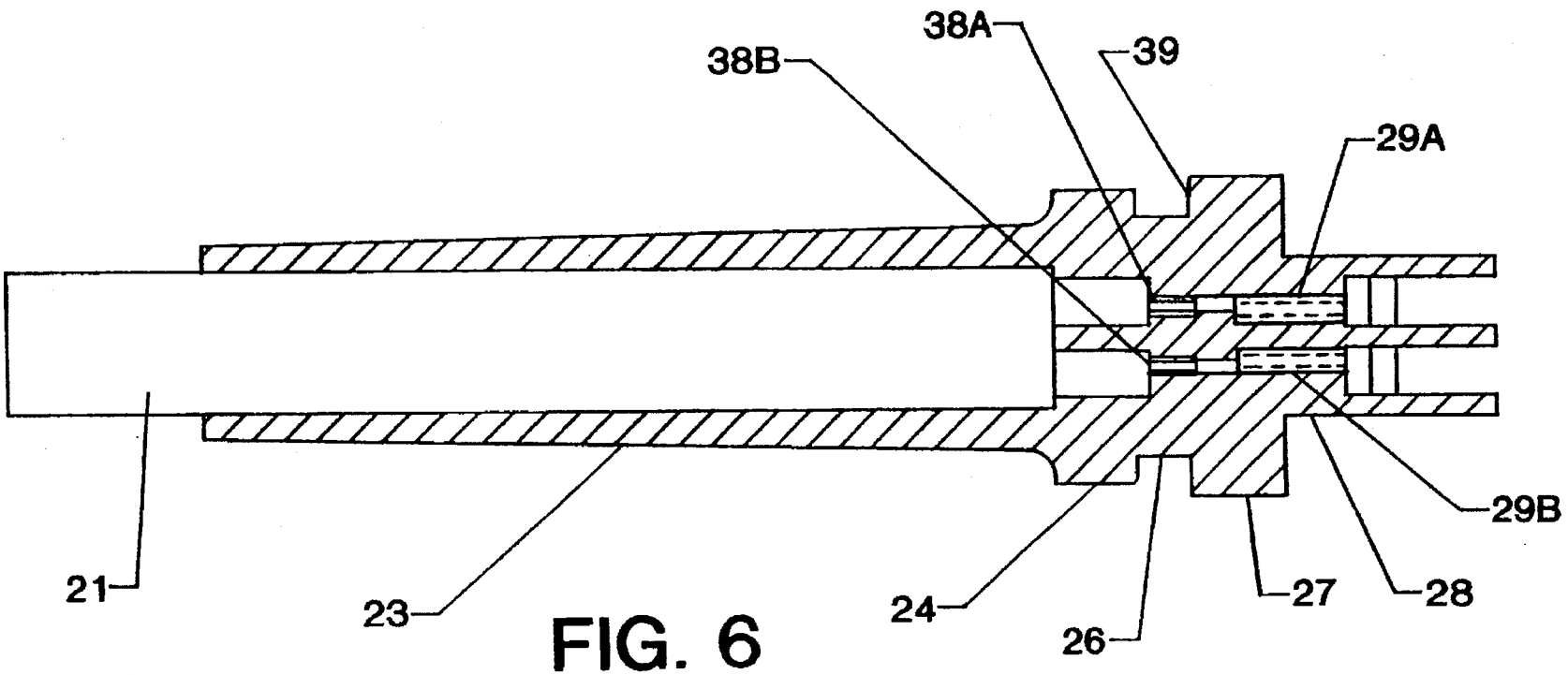
FIG. 6 is a partial top view of half of the supply cord assembly of FIG. 1.

Flange 24, spacer 26, and retaining head 27 are integral with one another and are pre-assembled. Referring to FIG. 6, a longitudinal bottom half section of the strain relief tail, flange, spacer and retaining head has the second end of the cord 21 inserted therein. The conductor wires 38A and 38B are crimped or welded to the female contacts 29A and 29B. The hot wire 38B is electrically attached to contact 29B. The longitudinal top half section of the carrier 20 is placed on and permanently bonded to the bottom half section by a combination of heat and pressure and if desired, an appropriate adhesive.

A groove is formed between the flange 24 and the retaining head face 39. The retaining head 27 also forms the housing for electrical contacts 29A and 29B. As shown, there are two electrical contacts. However, where a three pronged plug is used, there would be three electrical contacts. The contacts may be either female or male contacts, but are preferably female contacts. The retaining head 27 has a protruding contact holder 28 that surround the contacts so that only a female contact insert is exposed.

The face 39 of the retaining head 27 usually abuts against the inner wall of the appliance. However, if the groove is too wide, a plastic washer may be used in the groove so that the face 41 of flange 24 is securely abutted against an outer surface of the appliance during use.

Figure 3:
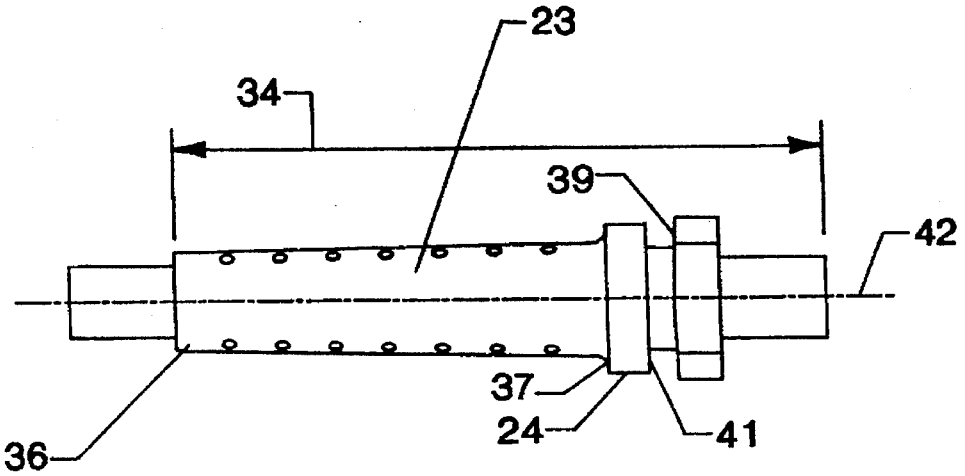
FIG. 3 is a bottom view of FIG. 2.
Figure 4:
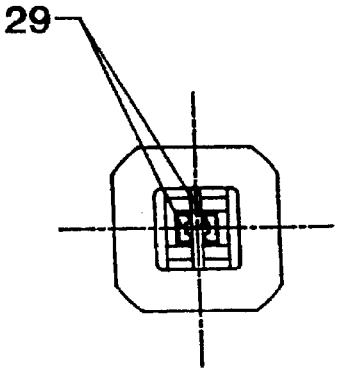
FIG. 4 is a right end view of FIG. 3.
Figure 5:
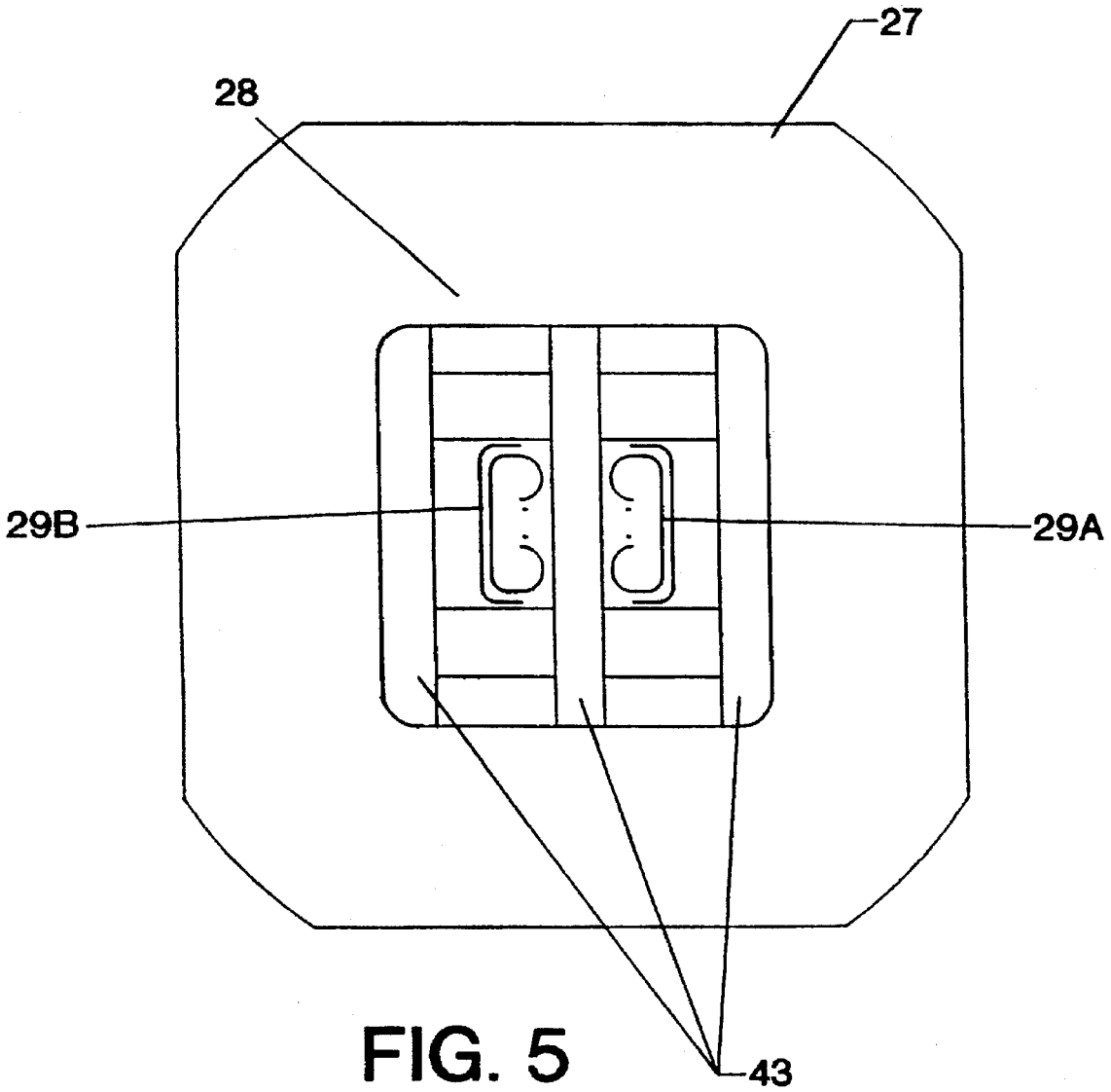
FIG. 5 is an enlarged view of FIG. 4.

In one embodiment, electrical contacts 29A and 29B include a longitudinal axis 66 that is parallel to the longitudinal axis 42 of flexible strain relief tail 23 and cable 21 (FIG. 3). Thus, the female electrical contacts 29A and 29B are accessible from the top of retaining head 27.

In addition, parallel walls 43 are located on opposite sides of female contacts 29A and 29B. Walls 43 project outwardly from and are perpendicular to the end face of contact holder 28. The walls 43 are evenly spaced and separate the contacts from one another. For a typical home appliance power cord, walls 43 are approximately 0.25 to 0.40 inches in length, 0.04 to 0.05 inches in width, and 0.40 to 0.6 inches in height, as measured from the end face of contact holder 28. The walls 43 are spaced from one another approximately 0.10 to 0.125 inches. Molded or assembled sleeves may also be used to insulate the mating terminals.

There are preferably two or three electrical female contacts 29 in retaining head 27. Moreover, the female contacts 29 correspond to male fittings 31 at one end of lead wires 32 (FIG. 1). The positive female contact is indicated in various fashions such as coloring or placing an indicia 44 next to the contact 29B.

Figure 7:
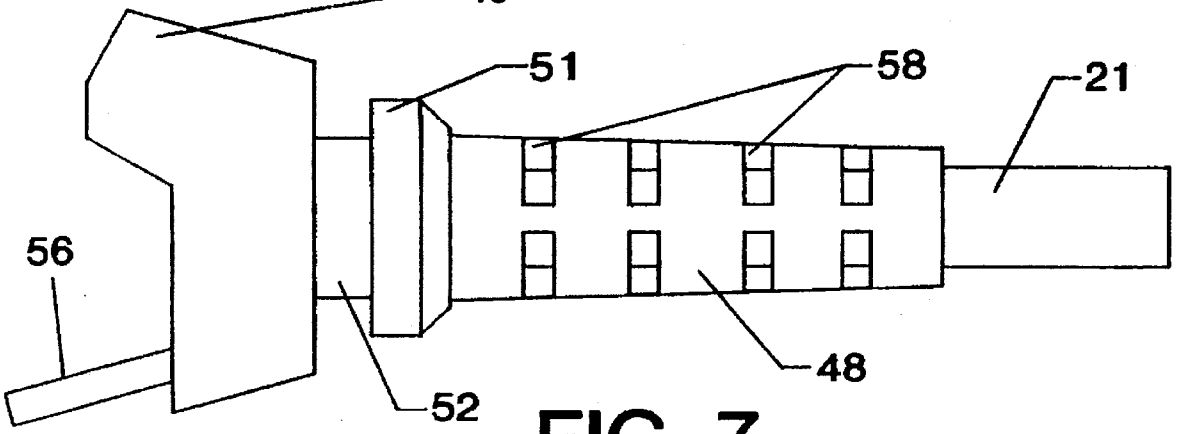
FIG. 7 is a front view of another assembly of the preferred embodiment of the present invention.
Figure 8:
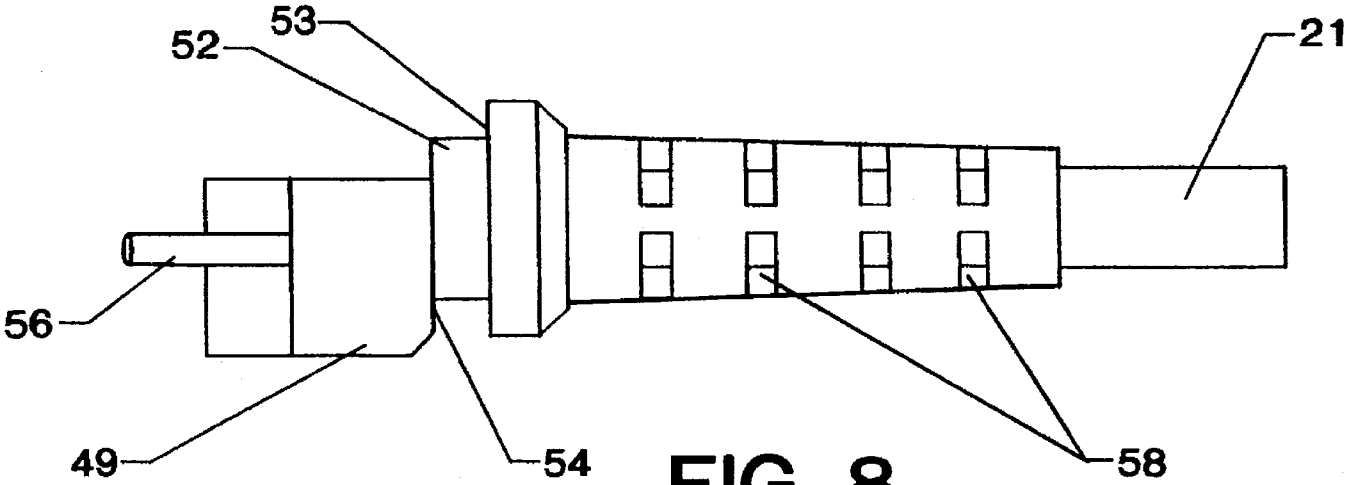
FIG. 8 is a bottom view of FIG. 7.
Figure 9:
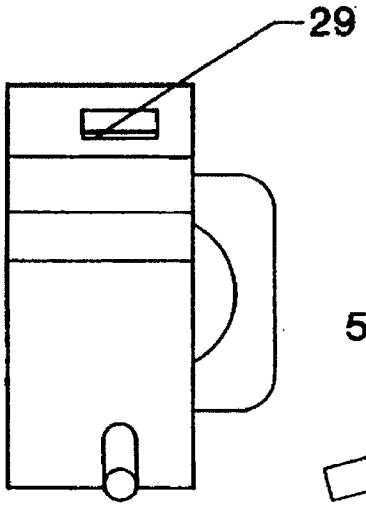
FIG. 9 is a left end view of FIG. 7.

FIGS. 6–8 show a variation of the above embodiment. Electrical female contacts 46 have a longitudinal axis that is oblique to the longitudinal axis 47 of flexible member 48 and cable 21. In addition, the retaining head 49 through which the oblique electrical female contacts extend is generally L-shaped and off-center from the flange 51 and the spacer 52. The flange face 53 forms an appliance wall receiving groove with the retaining head face 54. As stated above with regard to the carrier 20, the retainer head 49 is sized to fit within the electrical appliance or tool and the male end of the appliance or tool lead wire is mechanically electrically connected to the female contacts 29A and 29B.

Opposite the female contacts there extends from the retaining head an insulated lead 56 for direct connection to the appliance. The strain relief tail 48 has a plurality of rectangular bores 58 that extend to the surface of the cord 21.

FIG. 10 show still another variation of my invention. This illustrates a molded pre-assembled electrical contact carrier and strain relief 61 having a strain relief tail 62 with a plurality of holes 63, a flange 64 integral with retaining head 66 and a spacer 67 extending from the flange 64 to the retaining head 66 to form an appliance or tool retaining recess therebetween. A side face 69 of the retainer head and spacer are flattened and the bottom 68 of the face 69 forms a segment with the inner annular flange face 71. The face 69 has two female mechanical electrical contacts-72A and 72B.

The electrical female contacts 72A and 72B have an axis that is perpendicular to the longitudinal axis of the flexible strain relief 62 and cord 21. Thus, electrical female contacts 72 are accessible from the side of the retaining head 66. Moreover, in this embodiment, electrical contacts 72 are flush with side 69. As shown in FIG. 8, the female contacts 72A and 72B correspond to male contacts 73A and 73B on contact plate 74. A mechanical electrical connection is made between contacts 72 and 73. Electrical connections are then routed from contact plate 74 to the different connections within the appliance. This embodiment has particular application in appliances with narrow housings, such as, for example, as is common with hair dryers.

In use, a tool or appliance is assembled with lead wires or a contact plate permanently attached to the desired electrical connection in the tool or appliance—i.e., motor, heater, etc. The lead wires have on their ends a male or female contact which can be removed or mechanically and electrically connected to a corresponding male or female contact or power cord electrical contact carrier. Thus, assembling time and cost of the power cord to the appliance or tool, is substantially reduced. Further, worn out cords can be easily replaced and have the safety of the original power cord. A standard power cord can be made to fit a number of different tools and appliances merely by having the appliances use the same size electrical contacts on the end of their internal lead wires.

Variations of the above conventional power supply cords which electrically connect the specific devices are accomplished by cutting and terminating appropriate lengths of the lead wire.

The invention incorporates but is not limited to the use of pre-assembled carriers (PACS). PACS are insert molded housings which maintain the proper alignment of the electrical contacts. Their incorporation in a power supply cord facilitates automation of cord manufacture. In addition, the PAC assemblies will be designed to facilitate ultrasonic termination of the electrical contacts. They will be insert molded utilizing structural thermoplastic materials of sufficient hardness and tensile strength as to assure compliance with UL/CSA and international pull test requirements. Subsequent to termination to the flexible cordage, the PAC will be overmolded with flexible thermosetting or thermoplastic polymer.

The material from which the molded carriers are constructed includes any flexible thermosetting or thermoplastic polymer for providing optimum flex life. Moreover, although some approximate measurements have been provided, it should be understood that the size of the molded carrier may vary according to the size of the power supply cord.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the true scope and spirit of the invention.

The invention claimed is:

1. An electrical tool or appliance power supply cord assembly comprising:

a substantially cylindrical power cord having a first and second end;

a two or three prong plug attached to said first end of said power cord, an electrical contact carrier attached to said second end of said power cord;

said carrier having external means and internal means to attach said carrier to an electrical appliance or tool, said internal means having at least two female or male electrical contacts which are electrically attached to said power cord, said female or male electrical contacts mechanically and electrically connectable to corresponding male or female electrical contacts; said corresponding male or female electrical contacts connected to lead wires of said appliance;

said internal means having an exterior surface which abuts against an inwardly facing exterior surface, said inwardly facing exterior surface facing inwardly towards an interior of said appliance, said abutment occurring when said contact carrier is coupled to said appliance, said abutment preventing said contact carrier from being pulled in an axial direction away from said interior of said appliance;

said external means having an exterior surface, said exterior surface of said external means abutting up against an outwardly facing exterior surface, said outwardly facing exterior surface facing away from the interior of said appliance, said abutment occurring when said contact carrier is coupled to said appliance, said abutment preventing said power cord from moving in an axial direction towards the interior of said appliance.

2. The power supply cord assembly of claim 1 wherein said carrier insert includes a frustro conical strain relief tail, said external means is a flange attached to said relief tail, said flange preventing said power cord from being moved inside said appliance, and said internal means is a retaining head attached to said flange, said retaining head having at least two female or male electrical contacts on the end facing the interior of an appliance or tool.

3. The power supply cord assembly of claim 2 wherein said contacts of said retaining head have a longitudinal axis that is parallel to the longitudinal axis of said power cord and wherein said retaining head having said contacts is enclosed in said appliance and permanently coupled thereto when said contact carrier is coupled to said appliance.

4. The carrier of claim 3 wherein said exterior means is a flange and said internal means is a retaining head spaced from said flange to form an appliance retaining groove between said flange and said retaining head.

5. The power supply cord assembly of claim 2 wherein said contacts of said retaining head are on a side face of said retaining head and have a longitudinal axis that is perpendicular to the longitudinal axis of said power cord and wherein said retaining head having said contacts is enclosed in said appliance and permanently coupled thereto when said contact carrier is coupled to said appliance.

6. The carrier of claim 5 wherein said retaining head includes a retaining head surface that is sized to securely abut against an inner surface of the electrical tool or appliance when attached to the tool or appliance, said abutment preventing a disconnection of said cord assembly upon a sever pulling of said power cord, and said retaining head having at least a pair of electrical female or male contacts mechanically accessible to appliance lead wires having corresponding contacts on the ends thereof.

7. The carrier of claim 6 wherein a groove is sized to receive a portion of a receptacle, said retaining head electrical contacts are female electrical contacts, said female contacts have a longitudinal contact axis that is parallel to the longitudinal axis of said strain relief.

8. The carrier of claim 6 wherein the retainer head contacts have a longitudinal axis that is perpendicular to the longitudinal axis of said strain relief, said retaining head having said contacts enclosed in said appliance and permanently coupled thereto when said contact carrier is electrically coupled to said appliance.

9. The carrier of claim 6 wherein the retainer head contacts have a longitudinal axis that is obligue to the longitudinal axis of said strain relief, said retaining head having said contacts enclosed in said appliance and permanently coupled thereto when said contact carrier is electrically coupled to said appliance.

10. The power supply cord assembly of claim 2 wherein said contacts of said retaining head have a longitudinal axis that is obligue to the longitudinal axis of said power cord and wherein said retaining head having said contacts is enclosed in said appliance and permanently coupled thereto when said contact carrier is coupled to said appliance.

11. A molded plastic or rubber pre-assembled electrical contact carrier for connecting a power supply cord to an appliance comprising a flexible strain relief having a first strain relief end and a second strain relief end, said strain relief being sized to be permanently attached to one end of a power cord, said second strain relief end having interior and exterior means to attach said contact carrier to an electrical appliance or tool, said interior means having at least a pair of electrical female or male contacts adapted to mechanically receive and electrically connect said interior means to appliance lead wires having corresponding male or female contacts or soldered or welded copper stranding;

said interior means having an exterior surface which abuts against an inwardly facing exterior surface, said inwardly facing exterior surface facing inwardly towards an interior of said appliance, said abutment occurring when said strain relief is coupled to said appliance, said abutment preventing said contact carrier from being pulled in an axial direction away from said interior of said appliance;

said exterior means having an exterior surface, said exterior surface of said exterior means abutting up against an outwardly facing exterior surface, said outwardly facing exterior surface facing away from the interior of said appliance, said abutment occurring when said strain relief is coupled to said appliance, said abutment preventing said power cord from moving in an axial direction towards the interior of said appliance.

12. An electrical tool or appliance power supply cord assembly comprising:

a substantially cylindrical power cord having a first and second end;

a two or three prong plug attached to said first end of said power cord;

an electrical contact carrier attached to said second end of said power cord;

said carrier having an external means and an internal means to attach said carrier to an electrical appliance or tool;

at least two female or male electrical contacts disposed on said internal means, said female or male electrical contacts electrically coupled to said power cord, said female or male electrical contacts mechanically and electrically connectable to corresponding male or female electrical contacts which are disposed on lead wires connected to said appliance;

said external means and internal means permanently coupled to said appliance when said contact carrier is coupled to said appliance.

13. An electrical tool or appliance power supply cord assembly comprising:

a substantially cylindrical power cord having a first and second end;

a two or three prong plug attached to said first end of said power cord;

an electrical contact carrier attached to said second end of said power cord;

said carrier having an external means and an internal means to attach said carrier to an electrical appliance or tool;

at least two female or male electrical contacts disposed on said internal means, said female or male electrical contacts electrically coupled to said power cord, said female or male electrical contacts mechanically and electrically connectable to corresponding male or female electrical contacts which are disposed on lead wires connected to said appliance;

said internal means preventing a pulling on said power cord in a direction axially away from said appliance from causing a load on said lead wires.

* * * * *